US007207286B2

(12) United States Patent
Tafoya

(10) Patent No.: US 7,207,286 B2
(45) Date of Patent: Apr. 24, 2007

(54) TRI-POINT HYDRO SLED

(76) Inventor: Samuel Barran Tafoya, 135-41st St. Cir. E, Bradenton, FL (US) 34208

( * ) Notice: Subject to any disclaimer, the term of this patent is extended or adjusted under 35 U.S.C. 154(b) by 96 days.

(21) Appl. No.: 11/127,998

(22) Filed: May 12, 2005

(65) Prior Publication Data

US 2006/0254493 A1 Nov. 16, 2006

(51) Int. Cl.
*B63B 1/32* (2006.01)

(52) U.S. Cl. ..... 114/290

(58) Field of Classification Search ..... 114/288, 114/290

See application file for complete search history.

(56) References Cited

U.S. PATENT DOCUMENTS 3,469,549 A * 9/1969 Rae ..... 114/288
4,348,972 A * 9/1982 Parsons ..... 114/39.26
4,924,797 A * 5/1990 Solia ..... 114/288
5,634,419 A * 6/1997 Cymara ..... 114/56.1
5,713,293 A * 2/1998 Shiffler et al. ..... 114/61.27
5,934,218 A * 8/1999 Chen ..... 114/288
6,086,436 A * 7/2000 Ishigaki ..... 440/38

* cited by examiner

*Primary Examiner*—Stephen Avila
(74) *Attorney, Agent, or Firm*—Dorothy S. Morse

(57) ABSTRACT

A marine vessel that planes over the water in a straight ahead mode and has a V-shaped bow configuration, two lateral rails, a water jet intake aft of the bow, and a water jet discharge through the transom above the water line. The vessel's tri-point contact with the water at high speeds permits sled-like movement with minimal wet area under the hull along the center aft of the water jet intake. It moves fast through the water, is stable, moves smoothly and silently through the water, makes little wake, and makes hard turns without loss of velocity. At idle and slow speed it is low in the water, while at high speed it rides high on the water with only the bow and rear rails in contact with the water. Vessel size and scale are not limiting factors. Applications include, but are not limited to, military, recreational, and sporting uses.

20 Claims, 13 Drawing Sheets

TRI-POINT HYDRO SLED

CROSS-REFERENCES TO RELATED APPLICATIONS

None.

BACKGROUND OF THE INVENTION—FIELD OF THE INVENTION

This invention relates to the field of marine vessels, specifically to a marine vessel having a V-shaped bow, a water jet intake rearward of the bow, two lateral rails, and a water jet discharge through the transom above the water line. The bottom of the V-shaped bow and the rear portions of the rails give the present invention its tri-point contact with the water. The rails allow it to move like a sled through the water and minimize the wet area under the hull along the center aft of the water jet intake, thus allowing the vessel to plane over the water while in a straight ahead mode. The configuration of the present invention allows it to move faster through the water, be more stable in choppy seas, move more smoothly and silently through flat water, make less wake, and make quicker and tighter turns than vessels of comparable size. Also, its water jet propulsion permits operation without an external propeller, a safety advantage. At rest or at slow speed the present invention vessel is low in the water, while at high speed it rides high on the water. The portion of the 'V' configuration of the bow immediately forward of the water jet intake is configured to allow near continuous water intake for the water jet propulsion. Size and scale are not limiting factors for the present invention. Applications may include, but are not limited to, military and sporting uses.

BACKGROUND OF THE INVENTION—DESCRIPTION OF THE RELATED ART

Marine vessels experience a variety of disadvantages. They must be sufficiently stable to negotiate choppy seas. Yet, when the contact area between hull and water is increased, drag is increased and fuel efficiency is diminished. Also, marine vessels generally exhibit a tendency to bounce when making hard right or left turns and lose speed. An additional challenge for marine vessels in military applications is that they typically produce a disturbed backwash that prevents them from following closely in line one behind the other. Also, stealth and covert movement is compromised by the wake they leave behind, which can persist for hours. Further, military vessels typically sit high in the water and are thereby recognizable from a great distance. The present invention overcomes many of these disadvantages by providing a stable platform which can make hard right and left turns at full throttle without losing its velocity. Its tri-point configuration also diminishes bouncing in hard turns. Further, it rides high in the water at full speed, diminishing drag and providing greater fuel economy, while at idle and slow speeds it sits low in the water. There is no marine vessel known to have the same features and components as the present invention, nor all of its advantages.

BRIEF SUMMARY OF THE INVENTION—OBJECTIVES AND ADVANTAGES

The primary object of this invention is to provide a marine vessel hull design that provides a stable platform and reduces the wet area to a minimum so that the vessel is permitted to plane while it is in a straight ahead mode. It is also an object of this invention to provide a marine vessel hull design that permits hard turns at high speed and without bouncing. It is a further object of this invention to provide a marine vessel hull design that creates little disturbed backwash. It is also an object of this invention to provide a marine vessel hull design that permits a low profile in the water at idle or slow speeds. An additional objective of this invention is to provide a marine vessel hull design that rides high in the water at full speed to diminish drag and provide greater fuel economy.

The present invention is a marine vessel that has a V-shaped bow configuration and two lateral rails, the rear portion of which contact the water at high speed. Thus, in combination with the water contact provided by the V-shaped bow, the present invention has a tri-point contact with the water that allows the wet area under the hull along the center aft of the water jet intake to be minimized, and also allows it to move like a sled through the water and plane over the water while in a straight ahead mode. The present invention also has a water jet intake rearward from the V-shaped bow, the configuration of which permits near constant positioning of the water jet intake below water. In military applications the present invention can be used as an attack sled, since it moves faster through the water, is more stable in choppy seas, moves more smoothly and silently through flat water, makes less wake, and makes quicker and tighter turns with less bounce than vessels of comparable size. Also, at speed forward observation is good since the bow is kept low, with the lift from the sled rails beginning well behind the V-shaped configuration of the bow. For propulsion, water is drawn through the present invention via the water jet intake aft the V-shaped bow, with the discharge of the water jet being through the transom and above the water line. At rest or at slow speed the present invention vessel is low in the water and would appear at a great distance to be a fishing vessel, as opposed to a conventional military vessel. In contrast, at high speed the present invention rides high on the water and has a tri-point contact with the water, with only the rear portion of the rails and the V-shaped configuration of the bow in direct contact with the water, with the bow contact needed to provide a continued availability of water for the water jet intake. Size and scale are not limiting factors for the present invention. Applications may include, but are not limited to, military, recreational, and sporting uses.

While the description herein provides preferred embodiments of the present invention marine sled, it should not be used to limit its scope. For example, variations of the present invention, while not shown and described herein, can also be considered within the scope of the present invention, such as variations in the materials from which the components of the present invention can be made; the size of the vessel; the width of the rails; as well as the positioning of the water jet as long as it remains aft of the V-shaped bow. Thus, the scope of the present invention should be determined by the appended claims and their legal equivalents, rather than being limited to the examples given.

DETAILED DESCRIPTION OF THE INVENTION

Figure 7:
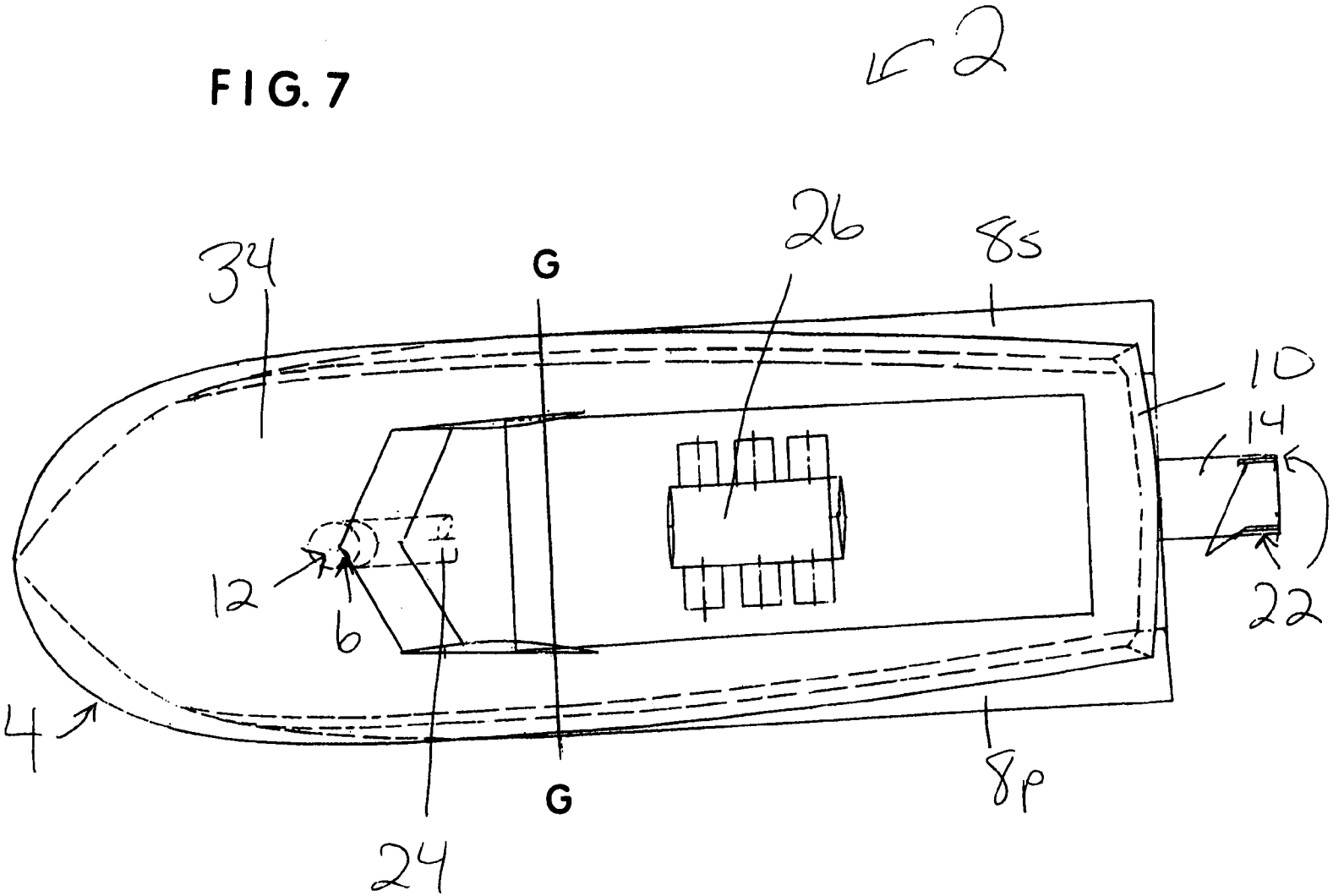
FIG. 7 is a top view of the most preferred embodiment of the present invention with its rudders positioned rearward from and in line with the water jet discharge in the transom.

The present invention vessel can be described as a marine attack sled, since it has a configuration creating a tri-point contact with the water at high speed. The bottom of the V-shaped bow in combination with the rear portion of its two lateral rails provide the three water contact points. A water jet intake is located aft the V-shaped bow, with the water jet discharge located through the transom above the water line. Thus, the present invention is allowed to plane in a straight ahead mode at high speed while the wet area aft of the bow, when the vessel is running at high speed in flattened water, is maintained at a minimum for improved fuel efficiency, performance, turning without loss of velocity, and less backwash disturbance. When at idle or at low speed, the present invention vessel sits low in the water. However, at high speeds it simply climbs out of the water with only its tri-point areas remaining in contact therewith. A portion of the bow must remain in the water so as to provide a means of water intake for the jet intake that is typically located immediately aft of the V-shaped bow. When a right or left turn is entered upon, the present invention vessel does not drop from its level of planing or lose speed, as conventional naval vessels tend to do. Instead, in a very fast and tight turn, the present invention vessel will climb up on top of the water's surface on its port or starboard rail bottoms, as shown in the left turn in FIG. 8. The outboard rail relative to the turn climbs out of the water, while the inboard rail drops down into the water to grip and maintain directional stability, as shown in FIG. 7. The lower bow does not have provisions to cause lift above the surface of the water, thereby water intake into its water jet is not interrupted in a hard turn. Suction is rarely compromised. However, if suction is lost, recovery is instantaneous when the hull returns to running depth. It must be remembered that the wet area is held to a minimum, even in a turn, as well as in a forwardly direction. When the present invention marine vessel is running slowly, the hull will sink down to a low profile. In this mode, the discharge of the water jet remains above the water line, which makes it approximately sixty percent more effective that if would be configured to discharge fluid under water. This can be understood more readily with a comparison to a water hose pushed down into a bucket full of water. As the nozzle goes under the water's surface, one will feel a lessening of the force or reaction of the nozzle against one's hand. However, when the nozzle is pulled out of the bucket, the hose will very nearly pull away from one's grasp, or at least try to pull away.

Testing of the present invention was performed on a scale model approximately thirty inches in length and bears out the following stability characteristics. However, size is not considered a limiting factor and it is contemplated for the present invention to be thirty feet in length, sixty feet in length, one hundred feet in length, or any other needed length dimension appropriate to an intended application. One contemplated military application of the present invention structure is for that of a torpedo boat that is able to make hard left and right turns at full speed, without losing any velocity. Since the present invention configuration creates little disturbed backwash it greatly reduces the tendency to bounce in a hard turn. One advantage of reduced bouncing is that a more stable platform is provided during hard turns for the use of deck guns. Another advantage is that when a torpedo is released in a turn, the torpedo can be released much closer to the surface of the water. Further, when a fleet of present invention vessels are seen on the horizon at idle or at slow speed, their profile is low and they would appear as flat fishing boats instead of military vessels. In addition, when the fleet is running at speed, the wake is minimized to a light trail that will diminish rapidly to a flow of flattened water. Such flattened flow can allow the vessels to follow closely in line. Further, the present invention vessels can approach a point of attack at high speed, thus enhancing its stealth and covert movement. Since the present invention also successfully negotiates very choppy seas, and can be used in rolling seas although at slightly slower speeds than flat seas, use of the present invention with any efficient turbine engine would significantly upgrade existing military 'swift' boat patrol fleets.

Figure 1:
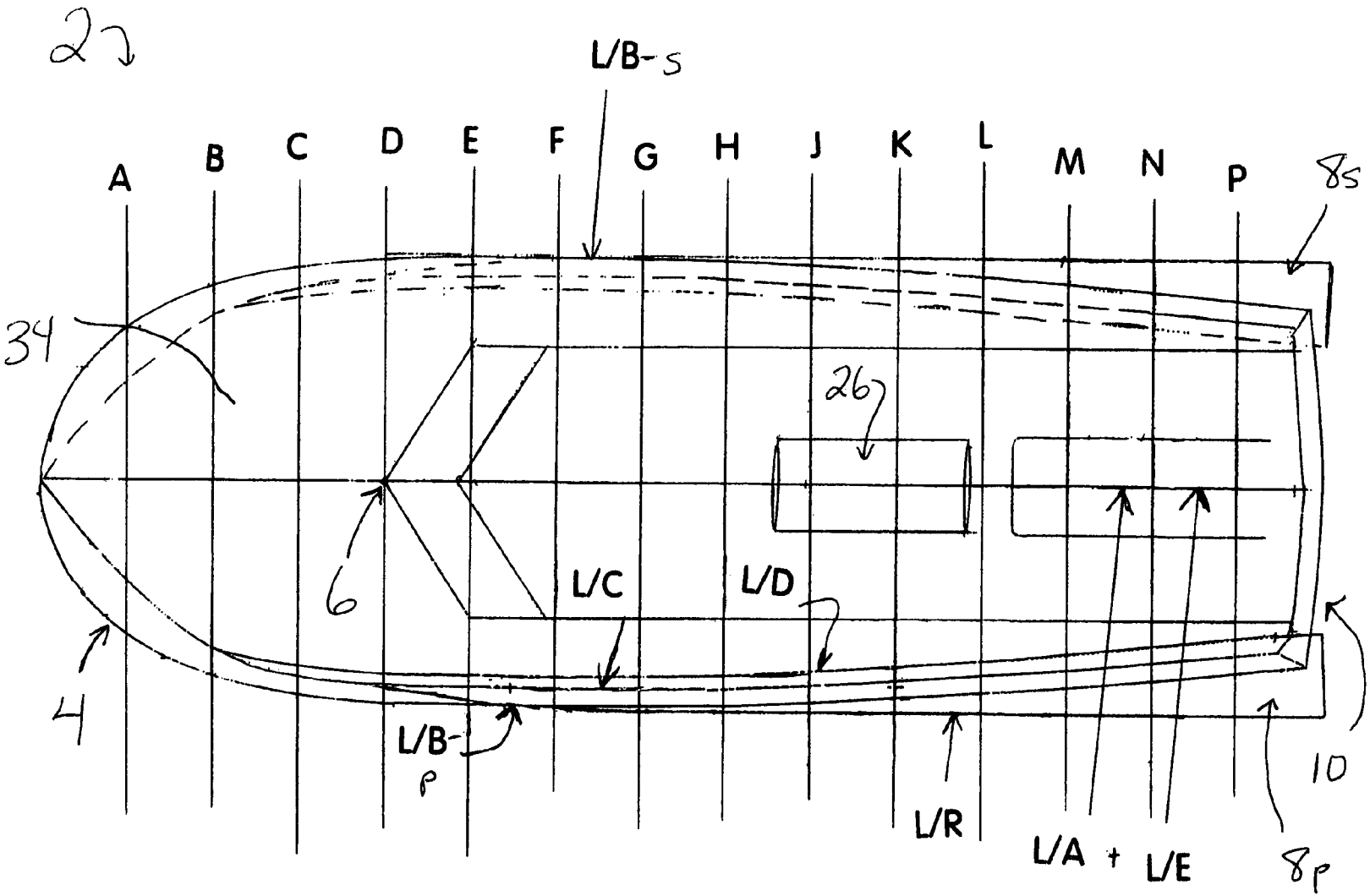
FIG. 1 is a top view of the most preferred embodiment of the present invention with its rails extending rearwardly beyond the transom, and front-to-back sections designated with progressively higher alphabet markings.
Figure 2:
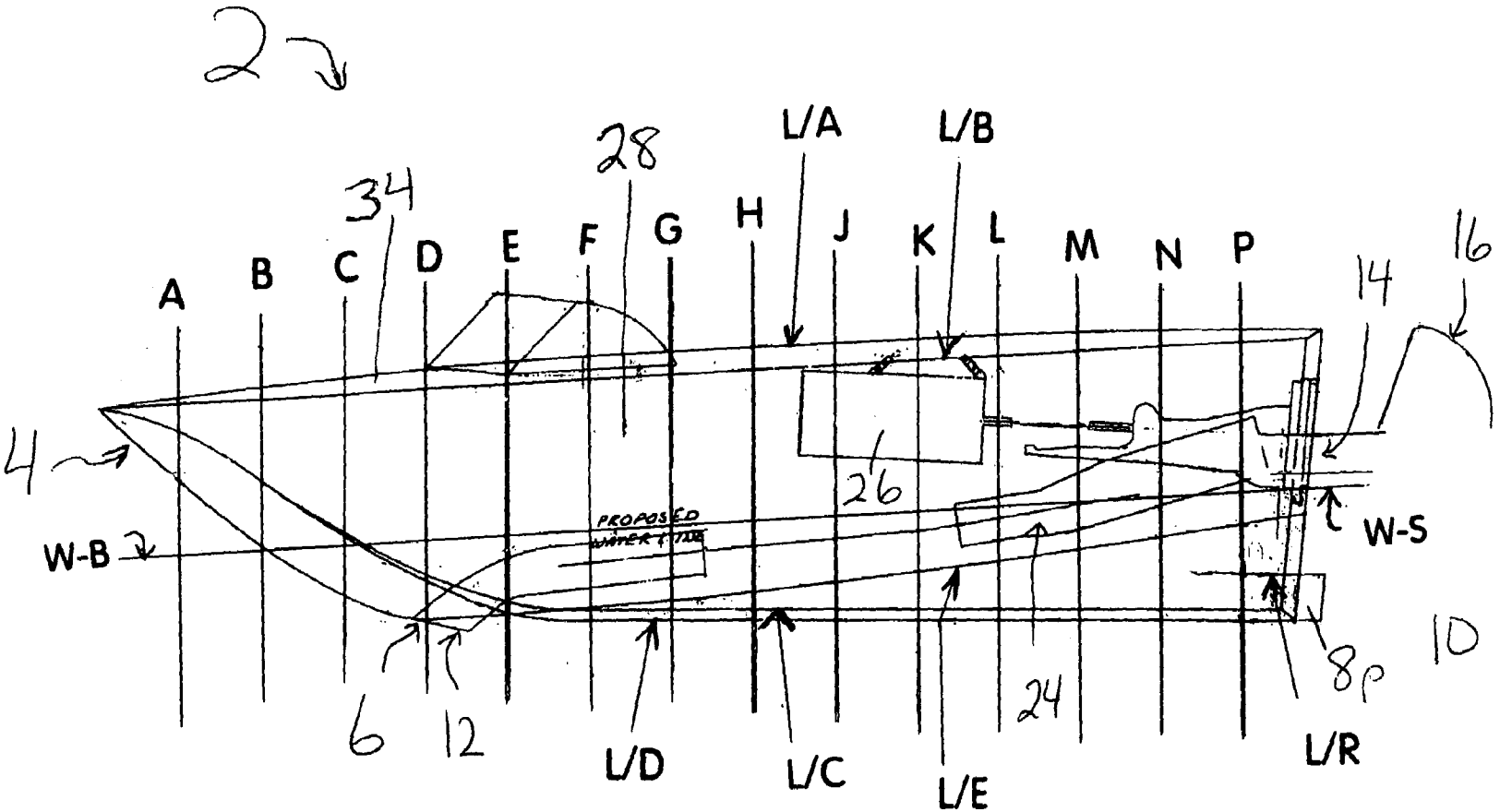
FIG. 2 is a side view of the most preferred embodiment of the present invention with its bow having a V-shaped configuration, its water jet intake aft of the 'V' configuration, and its water jet discharge above the water line, with the same front-to-back sections in FIG. 1 also designated with identical alphabet markings.
Figure 3A:
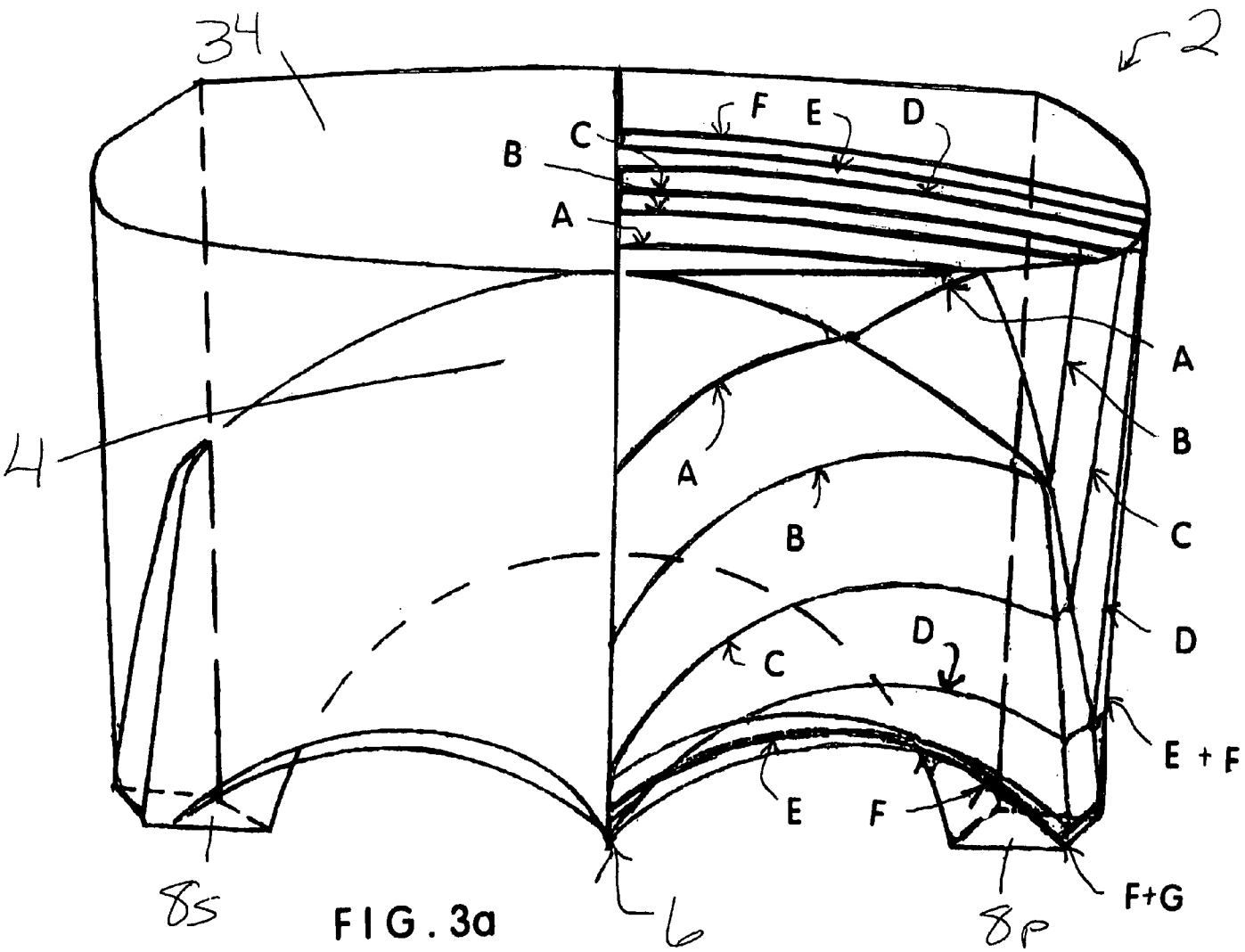
FIG. 3*a* is a front view of the most preferred embodiment of the present invention with its bow having a V-shaped configuration and the rear portion of its two lateral rails providing the three contact points with the water when the vessel travels at high speed, with some of the front-to-back sections in FIG. 1 designated with identical alphabet markings on the right half.
Figure 3B:
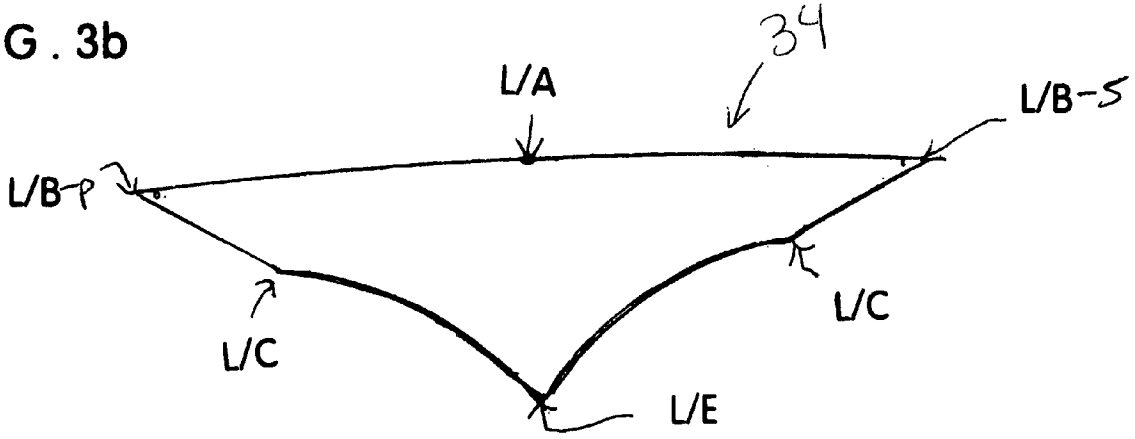
FIGS. 3*b*–3*f* are front views of some of the front-to-back sections in the most preferred embodiment of the present invention, and represent the sections A–E as shown in FIGS. 1 and 2.
Figure 3C:
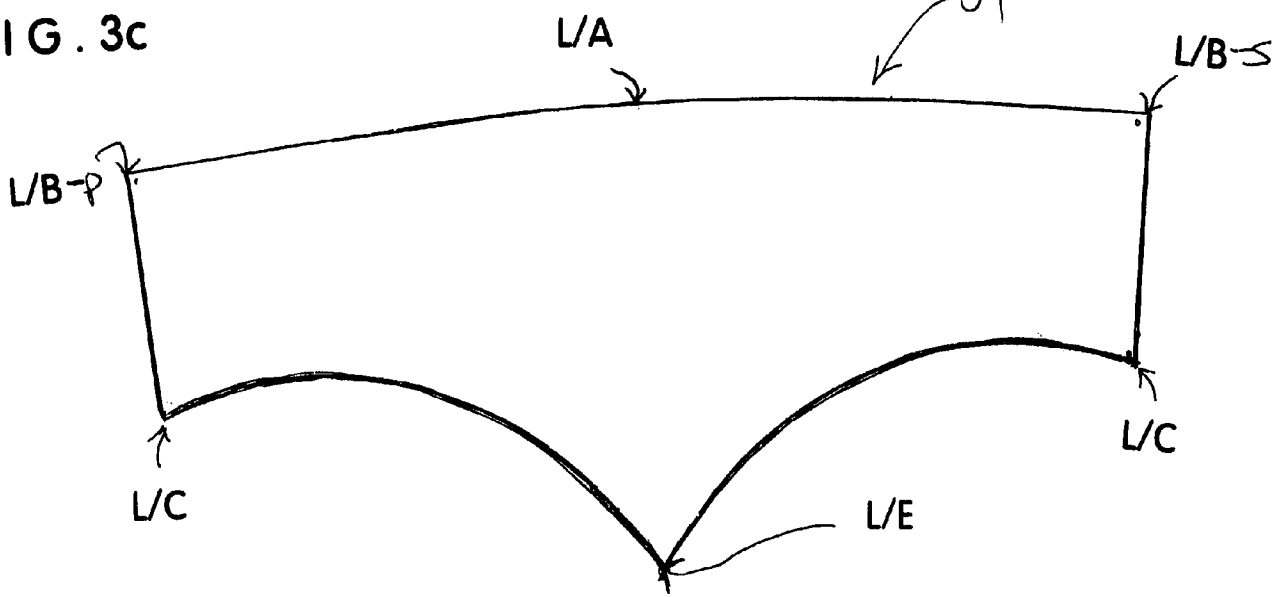
Figure 3D:
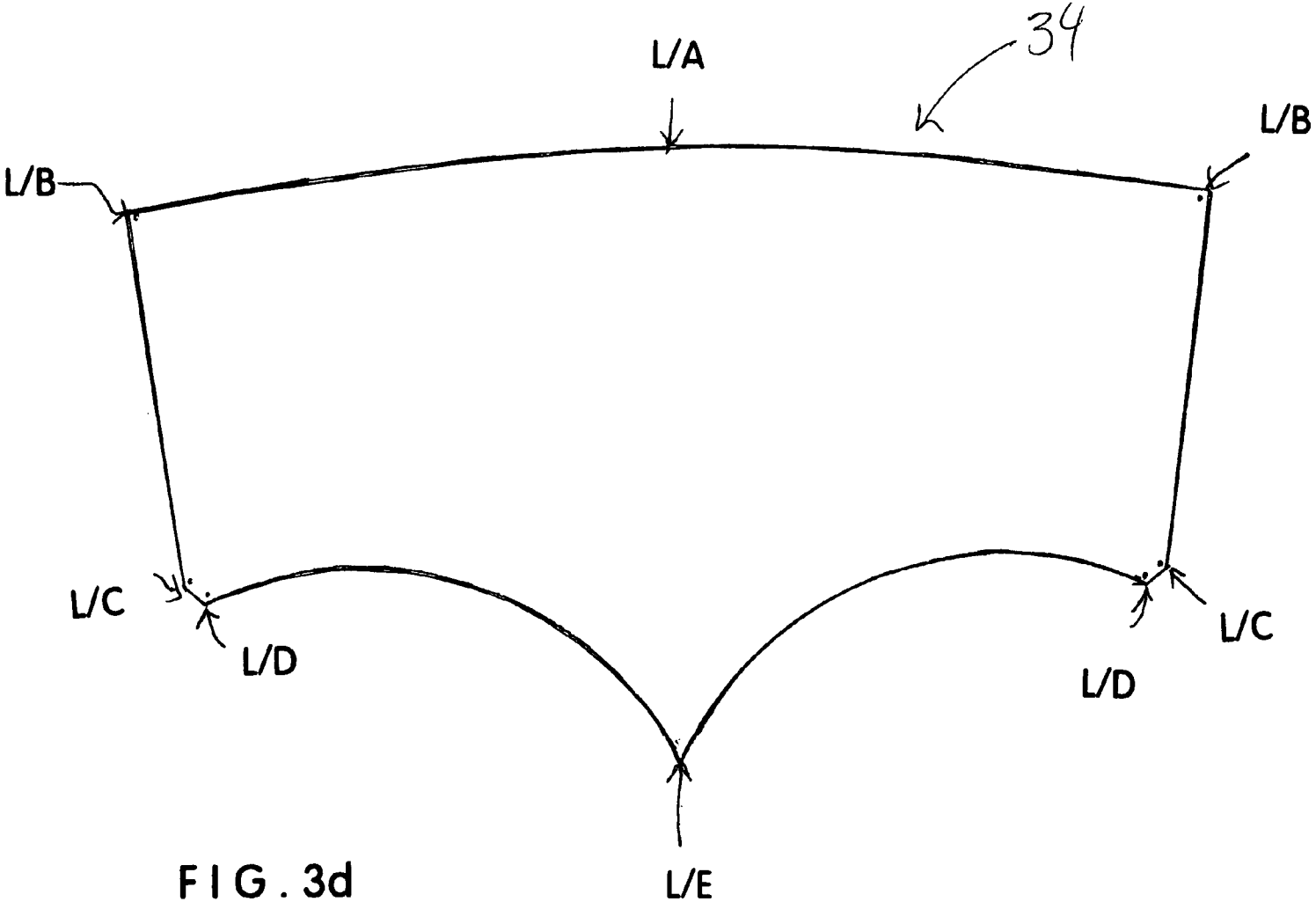
Figure 3E:
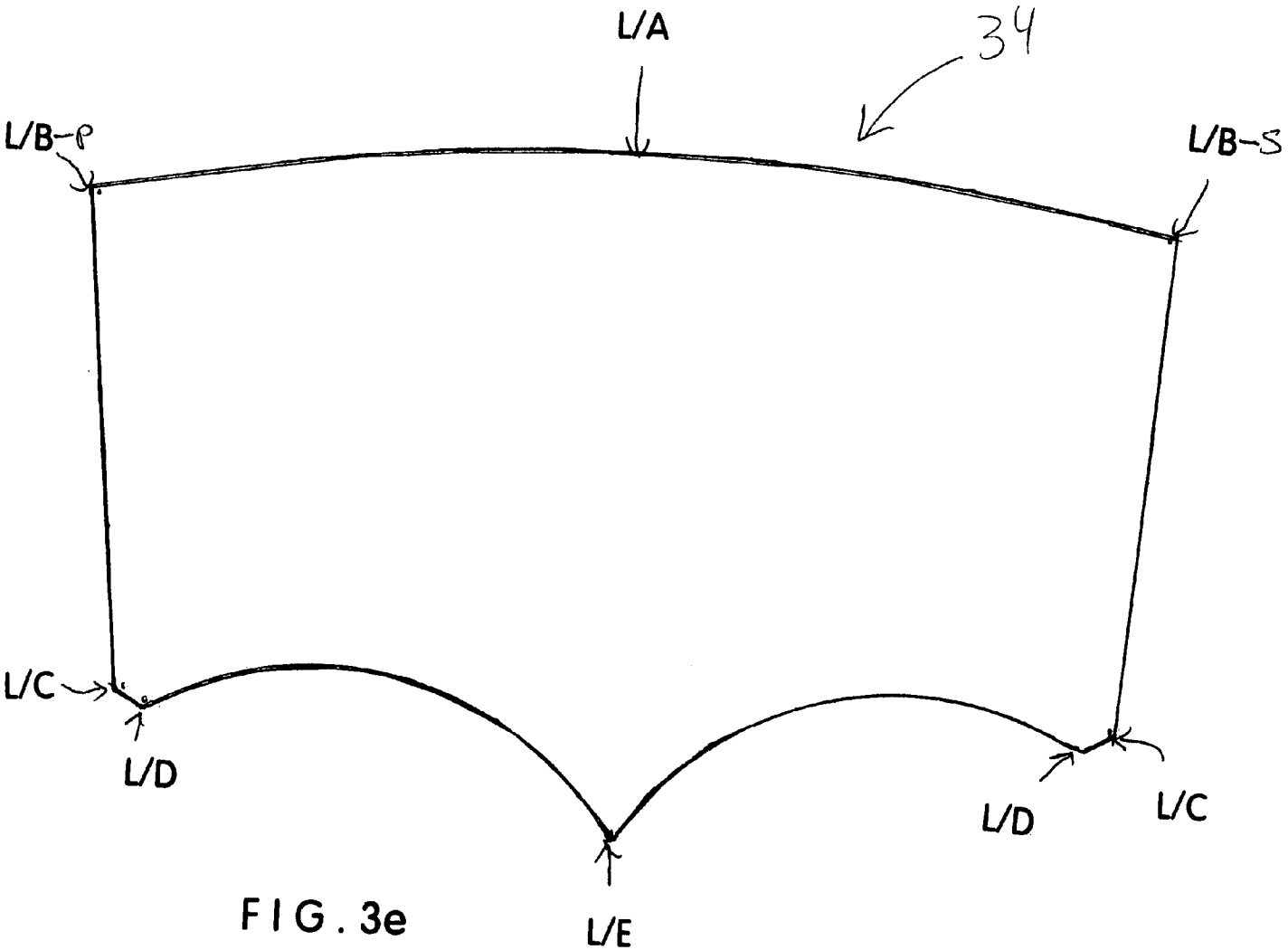
Figure 3F:
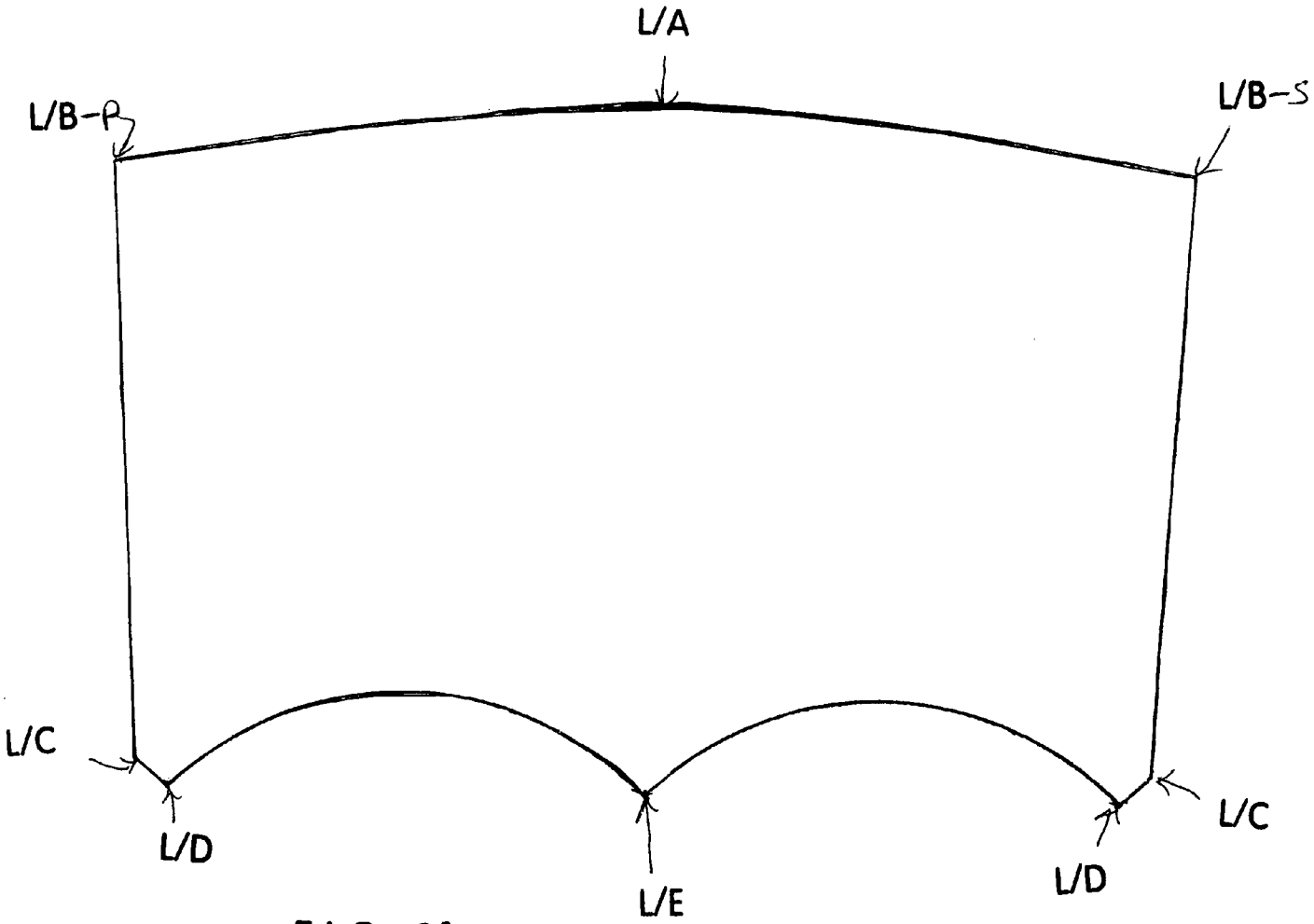
Figure 4:
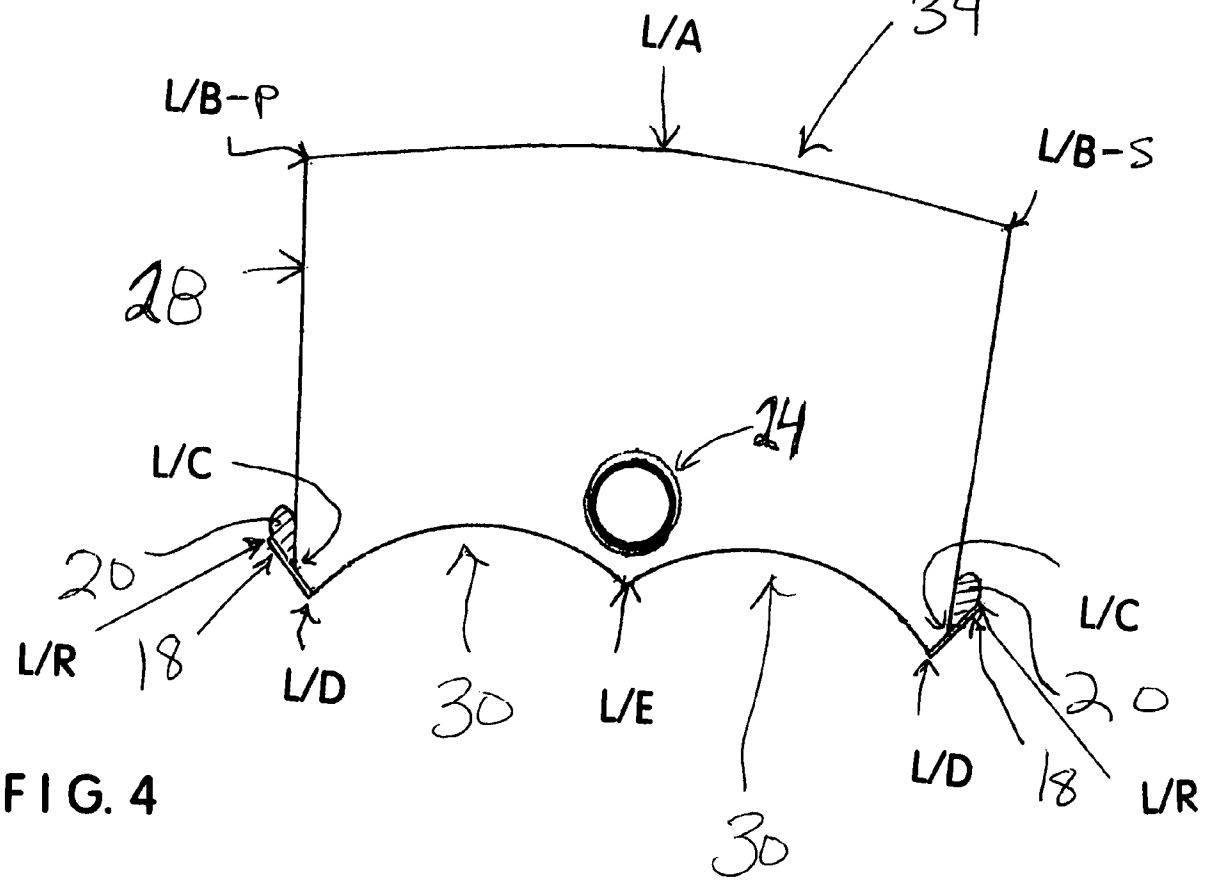
FIG. 4 is a middle section in the most preferred embodiment of the present invention, taken along line G—G in FIGS. 6 and 7, and which is approximately equivalent to the section G marked FIGS. 1 and 2.
Figure 5:
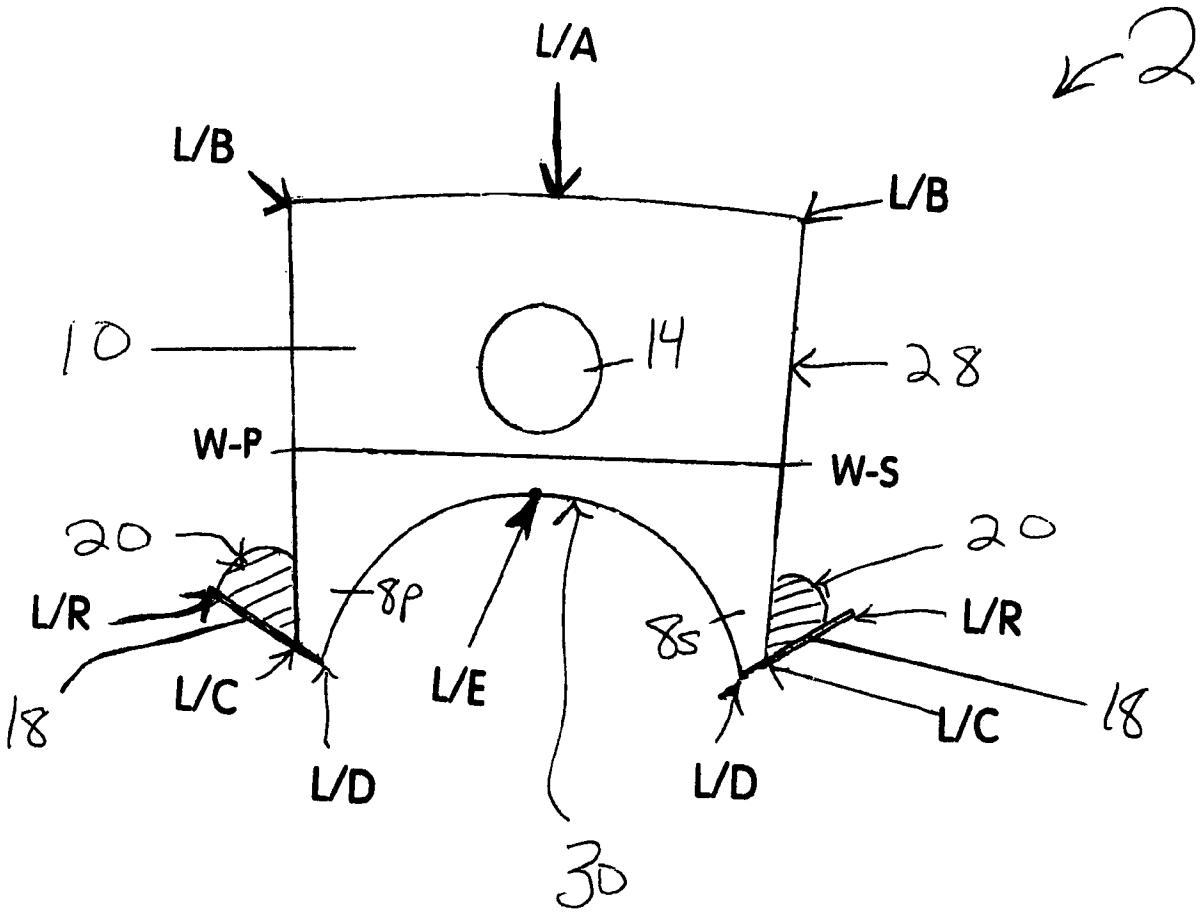
FIG. 5 is a rear view of the most preferred embodiment of the present invention with the water jet discharge in its transom above the water line.
Figure 6:
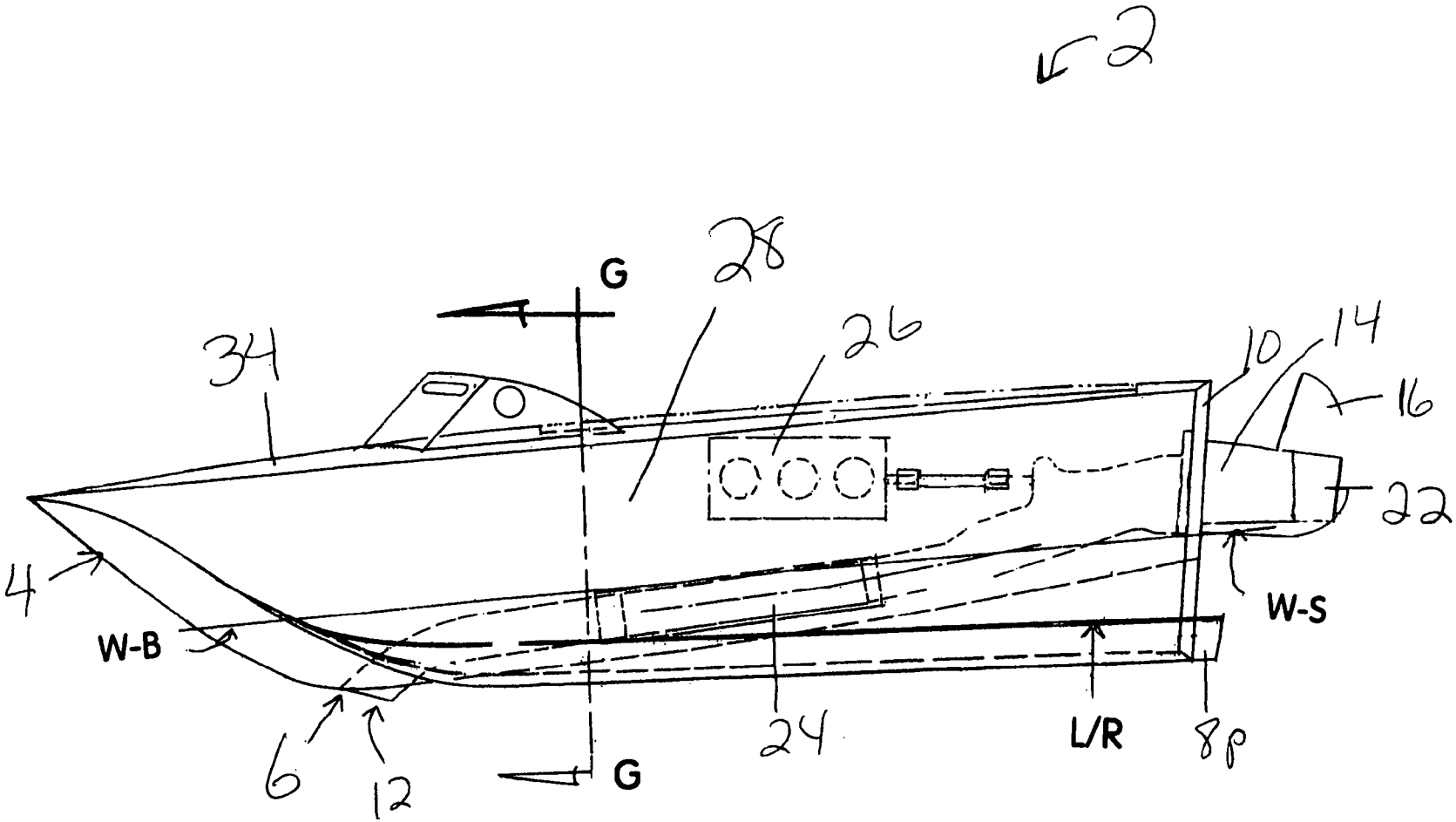
FIG. 6 is a side view of the most preferred embodiment of the present invention with a V-shaped bow, water jet propulsion, power unit, sled rail, a reverse gate, and rudder.
Figure 8:
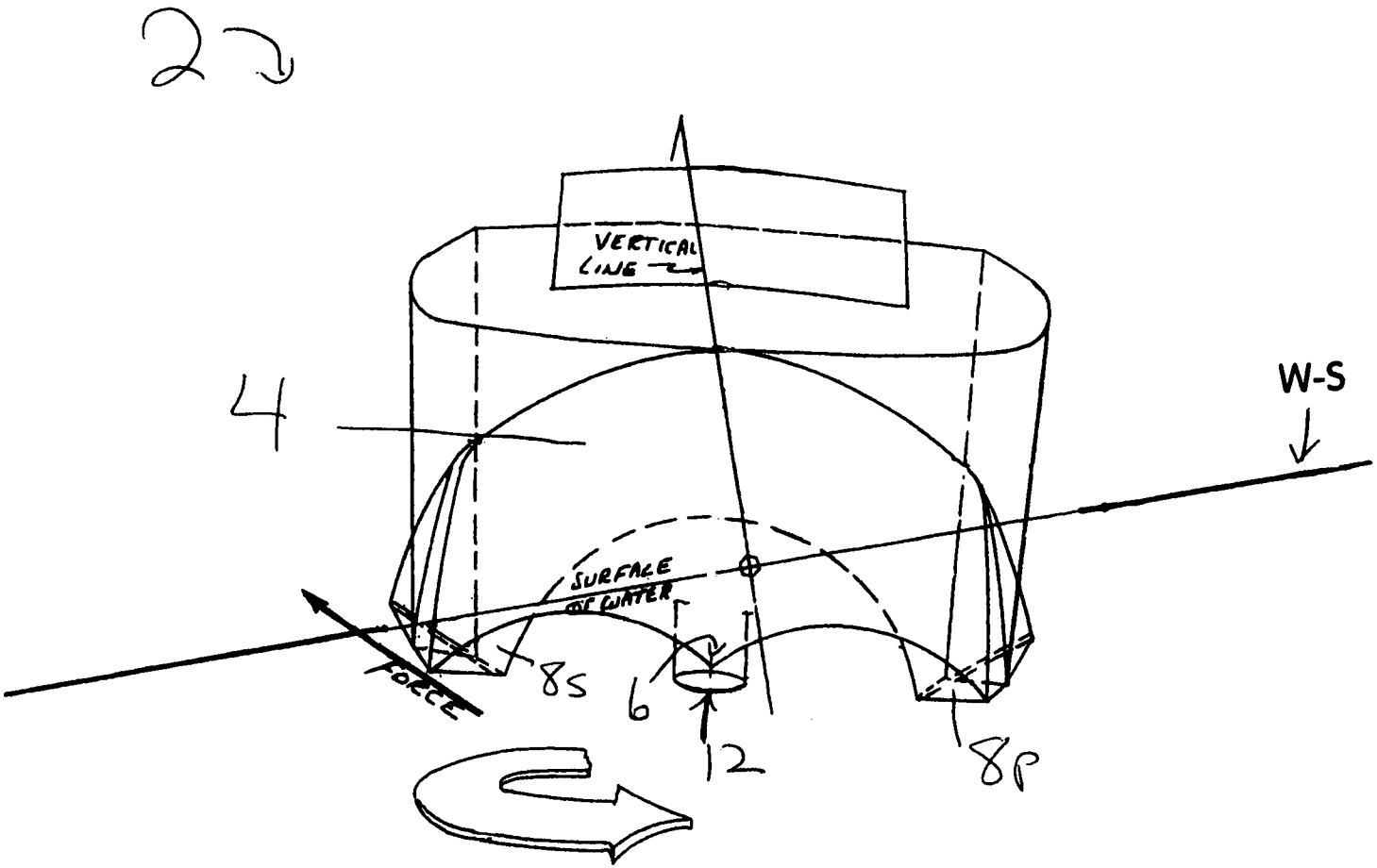
FIG. 8 is a front view of the most preferred embodiment of the present invention in a left turn, with a large lower arrow showing the direction of the turn and lines showing the water surface relative to the vessel, a vertical position relative to the water surface, and the direction of force experienced by the vessel during the turn.
Figure 9:
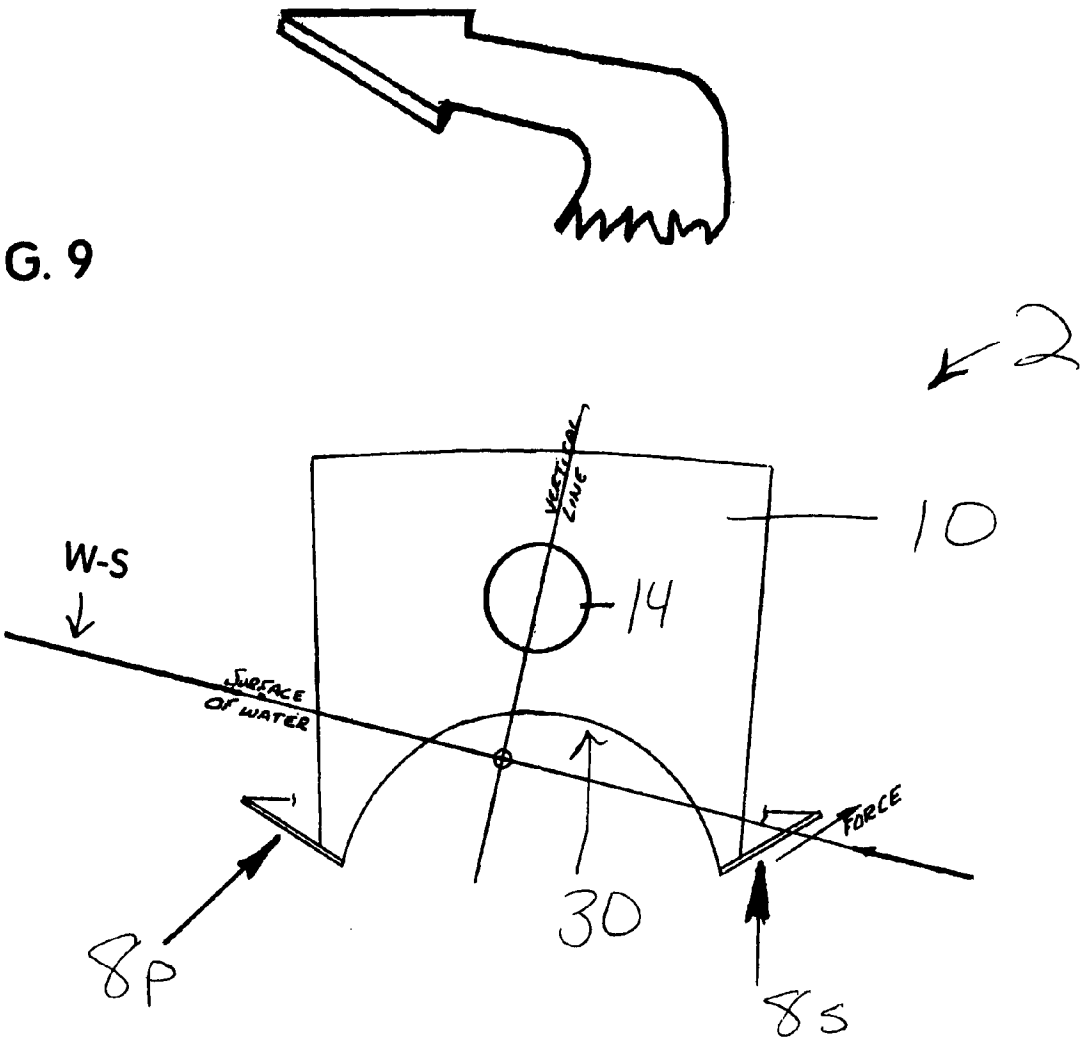
FIG. 9 is a rear view of the most preferred embodiment of the present invention in a left turn, with a large upper arrow showing the direction of the turn and lines showing the water surface relative to the vessel, a vertical position relative to the water surface, and the direction of force experienced by the vessel during the turn.

FIGS. 1–5 show the construction of the hull 28 of the most preferred embodiment 2 of the present invention, as well as that of its bow 4 and transom 10, while FIGS. 6–9 show the rudders 22 and reverse gate 16 used by most preferred embodiment 2 for steering, idle, turns, and reverse of direction. FIG. 1 shows most preferred embodiment 2 having front-to-back sections designated with progressively higher alphabet markings, a central power unit 26, and rails 8*p* (on the port side) and 8*s* (on the starboard side) extending rearwardly beyond transom 10. FIG. 2 also shows most preferred embodiment 2 with the same front-to-back alphabetically marked sections designated in FIG. 1, bow 4 having a V-shaped configuration, a water jet intake 12 aft of the lowest portion 6 of the V-shaped bow 4, and its water jet discharge 14 through transom 10 above the line W-B/W-S indicating the approximate line anticipated for the water surface level relative to hull 28 while it is at slow speed or idle. FIG. 3*a* shows bow 4 having a V-shaped configuration, with some of the section lines in FIGS. 1 and 2 present on the right half of the illustration to identify the location of front-to-back sections in hull 28 relative to bow 4. FIG. 3*a* also shows the lowest point 6 on bow 4 and the rear portion of two lateral rails 8*p* and 8*s* providing the three contact points with the water when most preferred embodiment 2 rises up out of the water to travel at high speed. FIGS. 3*b*–3*f* are front views of some of the front-to-back sections in most preferred embodiment 2, and represent the sections A–G as shown in FIGS. 1 and 2, while FIG. 4 is a middle section taken along line G—G in FIGS. 6 and 7 and which is approximately equivalent to the section G marked FIGS. 1 and 2. FIG. 5 shows that its water jet discharge 14 is located through its transom 10 and established above the line W-P/W-S representing the water surface supporting hull 28 at slow speeds and at idle. FIGS. 6–7 show most preferred embodiment 2 having a reverse gate 16 and rudders 22 in line with the water jet discharge 14 in the transom 10, while FIGS. 8–9 show most preferred embodiment 2 in a left turn, with FIG. 8 looking at bow 4 and FIG. 9 looking at transom 10, with a large arrow in each illustration showing the direction of the turn and a first line showing the water surface relative to the vessel, a second line showing a vertical position relative to the water surface, and a third line showing the direction of force experienced by the vessel during the turn.

FIG. 1 is a top view of the most preferred embodiment 2 of the present invention with its rails 8*p* and 8*s* extending rearwardly beyond transom 10. It is not critical for rails 8*p* or 8*s* to extend beyond transom 10, and the length and width dimensions of rails 8*p* and 8*s* may be proportionally larger or smaller than shown. As shown in FIG. 4, buoyancy material 20 may be added on top of rails 8*p* and 8*s* to lower the risk of sinking after a collision. The forward parts of rails 8*p* and 8*s* are narrow so bow 4 has minimal lift and the water jet intake 12 stays nearly all of the time below the water line W-B/W-S (shown in FIG. 2). Although FIG. 1 shows rails 8*p* and 8*s* starting approximately one-half of the distance between the foremost part of bow 4 and the water jet intake 12, such positioning is not critical. FIG. 1 further shows a power unit 26 in its preferred central position within most preferred embodiment 2. Since water jet intake 12 (shown in FIG. 2) and water jet discharge 14 operate without an external propeller, the safety of most preferred embodiment 2 during its operation is enhanced. The sections A–E in FIGS. 1 and 2 represent the bow 4 of most preferred embodiment 2, while sections E–P between bow 4 and transom 10 represent the structure comprising the mid-portion of hull 28. Further in FIG. 1, line L/A represents the center line of most preferred embodiment 2 along its deck 34, lines L/B-p and L/Bs respectively represent the port and starboard edges of deck 34, line L/C represents the chine of most preferred embodiment 2, line L/D represents the lower edge of the rails 8 of most preferred embodiment 2, line L/E represents the center line of most preferred embodiment 2 along its keel, and line L/R represents the top rail line of most preferred embodiment 2. The top rail lines L/R rearward from water jet intake 12 are approximately parallel to lines L/A and L/E.

FIG. 2 is a side view of the most preferred embodiment 2 of the present invention with its bow 4 having a V-shaped configuration, its water jet intake 12 aft of the lowest point 6 of the V-shaped configuration of bow 4, and its water jet discharge 14 through transom 10 above the proposed water line designated from bow to stem by the line W-B/W-S. Also, FIG. 2 shows deck 34 substantially parallel to water line W-B/W-S. FIG. 2 further shows power unit 26 centrally within hull 28, port rail 8*p*, and reverse gate 16 rearwardly from and in line with water jet discharge 14. FIG. 2 further shows the same sections A–P show for hull 28 in FIG. 1, with line L/A representing the center line of most preferred embodiment 2 along its deck 34, lines L/B representing the edge of deck 34, line L/C representing the chine of hull 28, line L/D representing the lower edge of rail 8*p*, line L/E representing the center line of most preferred embodiment 2 along its keel, and line L/R representing the top line of rail 8 in the most preferred embodiment 2. The top rail line L/R is approximately parallel to lines L/A and L/E. Only the rearmost portion of rail 8*p* is shown in FIG. 2 for clarity of illustration, while the full configuration of rails 8*p* and 8*s* is shown in FIG. 1.

FIG. 3 shows the most preferred embodiment 2 of the present invention with its bow having a V-shaped configuration, and section lines A–G on the right side of hull 28 as they would appear to a viewer (not shown) looking from bow 4 toward transom 10. In combination with the lowest point 6 of bow 4, the rear portion of lateral rails 8*p* and 8*s* provide the three contact points with the water when most preferred embodiment 2 rises up out of the water to travel at high speed. Each line A–F has three distinct parts each marked with its alphabetical designation, a substantially horizontally-extending upper section line designating the configuration of the section on deck 34, a substantially vertically-extending port-side section line, and an angled lower section line that defines the configuration of the section under bow 4. One reference to section G is also shown on the lower right side of the illustration. Since horizontally-extending section A is the forward most section relative to deck 34, with B, C, D, E, and F in that order positioned one behind the other, the horizontally-extending upper section line A as it would be observed from deck 34 appears in front of horizontally-extending upper section line B, horizontally-extending upper section line B appears in front of horizontally-extending upper section line C, C before D, D before E, and E before F. Similarly, since the V-shape of bow 4 requires section A to have the highest underside curvature, the angled lower section line A is higher than angled lower section line B, with angled lower section line B being higher than angled lower section line C, C higher than D, D higher than E, and E higher than F or G. With respect to the vertically-extending port-side lines for sections A–F that are located on the far right side of the illustration, vertically-extending port-side section line A is to the left of vertically-extending port-side section line B, vertically-extending port-side section line B is to the left of vertically-extending port-side section line C, with C left of D, and D slightly to the left of E and F. FIGS. 3*b*–3*f* respectively show the individual shapes of sections A–E that substantially form bow 4 of most preferred embodiment 2. FIG. 3*b* shows the section A of FIGS. 1 and 2 having a pentagonal configuration, with an elongated upper line between the two opposing points identified as L/B-s and L/B-p defining deck 34 and the point identified as L/A being the centerline of most preferred embodiment 2 along its deck 34. Below deck 34, two opposing line segments between points L/B and L/C define the upper portion of bow 4, with the lower concave segments between points L/C and L/E defining the lower portion of bow 4. The two points L/B represent the opposing lateral edges of deck 34, L/C represents the chine on opposing sides of hull 28, and L/E represents the keel line of most preferred embodiment 2. With respect to L/A and L/E, the two L/B's are located at a significantly greater distance from L/A and L/E than the two L/C's. In FIG. 3*c*, the configuration of bow 4 in the section B of FIGS. 1 and 2 shows the two L/B's nearly the same distance from L/A and L/E as the two L/C's. While the lower central portion of section B immediately above L/E is substantially similar in size and configuration to that shown in section A (see FIG. 3*b*), the upper portion of section B (in FIG. 3*c*) has a more rectangular configuration, while the overall appearance of section A is that of a triangle even though it has five distinct line segments that make it an irregular pentagon. In contrast and as shown in FIG. 3*d*, the section C from FIGS. 1 and 2 has an overall appearance similar to that of section B (as previously shown in FIG. 3*c*), with its upper portion being proportionally larger than is shown for section B (in FIG. 3*c*). However, in the section C shown in FIG. 3*d*, one is able to distinguish points L/D which represent the lower edge of rails 8 and were not present in sections A or B. FIG. 3*e* further shows the section D of FIGS. 1 and 2 having an overall appearance similar to that of section C (as shown in FIG. 3*d*), with its upper portion being proportionally larger than is shown for section C and points L/C and L/D spaced a little further away from one another as rails 8*p* and 8*s* widen in configuration through the mid-section of hull 28. Also, the extension 18 of rails 8*p* and 8*s* beyond chine L/C is not shown in FIGS. 3*a*–3*f* for clarity of illustration. As shown in FIG. 3*f*, the section E of FIGS. 1 and 2 has an overall appearance similar to that of section D (as shown in FIG. 3*e*), except that its point L/E does not extend as far below L/D and L/C as is shown in FIG. 3*e* since the configuration of keel L/E starts to become increasingly elevated in sections E–P to create tri-point contact with the water, as shown in FIG. 2.

FIG. 4 shows a middle section of most preferred embodiment 2 which is approximately equivalent to the section G in FIGS. 1 and 2, and is taken along line G–G in FIGS. 6 and 7. FIG. 4 shows the line L/A representing the center line of most preferred embodiment 2 along its deck 34, the two lines L/B-p and L/B-s respectively representing the port and starboard edges of deck 34, the two lines L/C representing the port and starboard chine of most preferred embodiment 2, the two lines L/D representing the lower edges of the port and starboard rails 8*p* and 8*s*, line L/E representing the center line of most preferred embodiment 2 along its keel, and lines L/R represents the top lines of rails 8*p* and 8*s* in the rail extensions 18 shown in FIGS. 4 and 5 extending beyond chine L/C. FIG. 4 also shows hull 28 having a water jet 24 therethrough near to keel line L/E, and buoyancy material 20 secured to the top portions of rails 8*p* and 8*s* for added buoyancy in the event that most preferred embodiment is involved in a collision. When most preferred embodiment 2 is at speed and going in a forwardly direction, most of the area designated by the number 30 remains dry, with the wet area in contact with the water being restricted to an area in bow 4 at the lowest portion 6 of its V-shaped configuration and lowest areas L/D on the rear portions of rails 8*p* and 8*s*.

FIG. 5 is a rear view of the most preferred embodiment 2 of the present invention showing the water jet discharge 14 through its transom 14 above the proposed water line W-P/W-S for travel at slow speeds and idle. Point L/E representing the keel line is at its highest elevation at transom 10 (as also shown in FIG. 1), creating a semi-circular appearance of the curved line L/D-L/E-L/D. When traveling at high speed, the area designated by the number 30 climbs out of the water and is no longer a wet area, with water contact then being a tri-point contact using only the lowest portion 6 of bow 4 and the rearmost portions of rails 8*s* and 8*p*. A substantial portion of the area 30 of hull 28 adjacent to curved line L/D-L/E-L/D is dry while most preferred embodiment operates at speed in a forwardly direction, with points L/D on the rear portions of rails 8*p* and 8*s* then providing the main contact with the water. In contrast, as shown in FIGS. 8 and 9, in making turns the outboard rail relative to the turn climbs out of the water (rail 8*s* in FIGS. 8 and 9), while the inboard rail (rail 8*p* in FIGS. 8 and 9) drops down into the water to grip and maintain directional stability. FIG. 5 shows buoyancy material 20 secured to the upper portion of rails 8*p* and 8*s* above rail extension 18, with line L/A representing the center line of most preferred embodiment 2 along its deck 34, the two lines L/B-p and L/B-s respectively representing the port and starboard edges of deck 34, the two lines L/C representing the port and starboard chine of most preferred embodiment 2, the two lines L/D representing the lower edges of the port and starboard rails 8*p* and 8*s*, line L/E representing the center line of most preferred embodiment 2 along its keel, and lines L/R represents the top lines of rails 8*p* and 8*s* in most preferred embodiment 2.

FIGS. 6 and 7 show most preferred embodiment 2 with a reverse gate 16 and two rudders 22 positioned rearward from and in line with transom 10. In contrast to prior art marine vessels (not shown), due to the high elevation of point L/E at transom 10, the reverse gate 16 directs water under the water jet discharge 14 into the area marked by the number 30 in FIGS. 4 and 5, and not toward transom 10. The configuration of rudders 22 and reverse gate 16 are not critical and each may have conventional configurations. FIGS. 6 and 7 both show centrally positioned power units, bow 4, deck 34, rail 8*p*, water jet 24, the lowest portion 6 of bow 4, water jet intake 12 aft of lowest point 6, and section line G—G. In addition, FIG. 6 shows hull 28 between bow 4 and transom 10, and line L/R representing the top line of rail 8*p* in most preferred embodiment 2. FIG. 7 also shows rail 8*s*.

FIGS. 8 and 9 show most preferred embodiment 2 in a left turn, with FIG. 8 showing a front view from bow 4 and FIG. 9 showing a rear view from transom 10. The inboard rail (which is 8*p* in a left turn) drops below the water surface to grip and maintain directional stability. Water intake at water jet intake 12 is not interrupted, and as shown in FIG. 8 the lowest portion 6 of bow 4 and water jet intake 12 remain under the water surface designated as W-S. As a routine, there is no bow lift during a turn by most preferred embodiment 2, unless unusually choppy seas are encountered, and when water jet intake 12 does come out of the water, the speed of most preferred embodiment 2 slows sufficiently to cause a lowering of its profile relative to water surface W-S, thereby promptly replacing water jet intake 12 under water surface W-S so that it can again draw in water for propulsion. Also, as shown in FIG. 9, a large portion of the area designated by the number 30 remains out of contact with the water during a turn, creating a faster and smoother turn than can be achieved by conventional marine vessels of similar size (not shown), with less bounce.

Thus, the water jet discharge 14 of the most preferred embodiment 2 of the present invention is preferably above the water line W-S while at rest, at full speed, in turns, and in reverse. Loss of planing height while in turns at any speed above idle is prevented by the present invention hull 28 configuration. Further, there is no bouncing of most preferred embodiment 2 at high speeds due to its tri-point contact with water surface W-S. Turning is positive since the sliding sideways motion experienced with conventional marine vessels is all but eliminated by the inboard rail (8*p* in FIGS. 8 and 9) dropping below the water surface W-S and gripping the water to maintain directional stability. In addition, the buoyancy of most preferred embodiment 2 at rest provides a low profile in the water due to the sled configuration of its planing surfaces, which allows hull 28 to lower itself in the water. This also considerably reduces the wet area under the hull 28 along the center line L/E aft of the water jet intake 12, with such dry area being designated by the number 30 in FIGS. 4, 5, and 9. With a reduced wet area, most preferred embodiment 2 can attain higher speeds with a given power source. Additionally, by providing buoyancy material 20 on the top of the extensions 18 of sled rails 8*p* and 8*s*, sinking after an underwater collision would be less apt to occur. Also, at speed forward observation is good since the configuration and placement of rails 8*p* and 8*s* keep bow 4 low and water jet intake 12 under water surface W-S, with the lift from the sled rails 8*p* and 8*s* beginning well aft of the V-shaped configuration of the bow 4 and water jet intake 12.

I claim:

1. A marine vessel comprising:

a V-shaped bow;

a transom;

a hull extending between said bow and said transom;

two lateral rails attached to said hull and extending aft from said bow rearwardly beyond said transom, said rails each having a rearward portion;

a water jet intake aft of said bow; and a water jet discharge through the transom and which remains above the water line of said hull while said vessel is at rest, at full speed, and in reverse, and whereby tri-point contact with the water is established at speed via said bow and said rear portions of said rails.

2. The vessel of claim 1 wherein said rails are configured to sufficiently narrow toward said bow to create lift for said vessel behind said water intake.

3. The vessel of claim 1 wherein said rails are each configured with a rail extension adapted for use as a step during rescue.

4. The vessel of claim 3 further comprising buoyancy material secured on top of said rail extensions.

5. The vessel of claim 1 wherein said rails are configured to sufficiently narrow toward said bow so that said vessel does not lose planing height while in turns at any speed above idle.

6. The vessel of claim 1 wherein said rails, said bow, and said hull are configured to create a tri-point contact with the water sufficient to reduce bounce of said vessel at all speeds above idle.

7. The vessel of claim 1 wherein said rails, said bow, and said hull are configured to allow the one of said rails that becomes the inboard rail in a turn to drop lower than the one of said rails tat becomes an outboard rail in the turn to sufficiently grip the water to reduce sideways sliding in a turn.

8. The vessel of claim 1 wherein said rails, said bow, and said hull are configured to create the buoyancy needed to produce a low profile in the water at rest and slow speeds, and a high profile at high speeds.

9. The vessel of claim 1 wherein said rails and said bow are configured to considerably reduce the wet area under said hull along its center aft of said water jet intake at speed and thereby allow said vessel to attain higher speeds with a given power source than vessels not having a tri-point contact with the water.

10. The vessel of claim 1 wherein said rails, said bow, and said hull are configured to maintain said bow in a low position at speed and thereby provide good forward observation.

11. The vessel of claim 1 wherein said rails are configured to sufficiently narrow toward said bow to create lift for said vessel behind said water intake, wherein said rails are each configured with a rail extension, and further comprising buoyancy material secured on top of said rail extensions.

12. The vessel of claim 11 wherein said rails are configured to sufficiently narrow toward said bow so that said vessel does not lose planing height while in turns at any speed above idle.

13. The vessel of claim 11 wherein said rails, said bow, and said hull are configured to create a tri-point contact with the water sufficient to reduce bounce of said vessel at all speeds above idle.

14. The vessel of claim 12 wherein said rails and said bow are further configured to create a tri-point contact with the water sufficient to reduce bounce of said vessel at all speeds above idle.

15. The vessel of claim 13 wherein said rails, said bow, and said hull are configured to allow the one of said rails that becomes the inboard rail in a turn to drop lower than the one of said rails that becomes an outboard rail in the turn to sufficiently grip the water to reduce sideways sliding in a turn.

16. The vessel of claim 14 wherein said rails, said bow, and said hull are configured to allow the one of said rails that becomes the inboard rail in a turn to drop lower than the one of said rails that becomes an outboard rail in the turn to sufficiently grip the water to reduce sideways sliding in a turn.

17. The vessel of claim 16 wherein said rails, said bow, and said hull are configured to create the buoyancy needed to produce a low profile in the water at rest and slow speeds, and a high profile at high speeds.

18. The vessel of claim 17 wherein said rails and said bow are configured to considerably reduce the wet area under said hull along its center aft of said water jet intake at speed and thereby allow said vessel to attain higher speeds with a given power source than vessels not having a tri-point contact with the water.

19. The vessel of claim 18 wherein said rails, said bow, and said hull are configured to maintain said bow in a low position at speed and thereby provide good forward observation.

20. The vessel of claim 1 wherein said rails and said bow are configured for tri-point contact with the water that considerably reduces the wet area under said hull along its center aft of said water jet intake at speed, thereby allowing said vessel to move smoothly and silently through the water, and make little wake.

* * * * *